US005622343A

United States Patent [19]

Morton

[11] Patent Number: 5,622,343

[45] Date of Patent: Apr. 22, 1997

[54] MAIL BOX MOUNTING DEVICE

[76] Inventor: Arthur D. Morton, 7350 Eagle Mills Rd., Waite Hill, Ohio 44094

[21] Appl. No.: 420,475

[22] Filed: Apr. 12, 1995

[51] Int. Cl.[6] ..... A47F 5/00

[52] U.S. Cl. ..... 248/131; 248/125.7; 248/418; 248/289.31; 232/17

[58] Field of Search ..... 248/288.11, 289.11, 248/289.31, 125.7, 131, 415, 417, 418; 232/17, 39

[56] References Cited

U.S. PATENT DOCUMENTS 3,407,997 10/1968 Wood ..... 248/417
4,893,747 1/1990 Roth ..... 248/131
5,400,958 3/1995 Walker ..... 248/131
5,458,286 10/1995 Paschal ..... 248/131

*Primary Examiner*—Leslie A. Braun
*Assistant Examiner*—Gwendolyn Wrenn
*Attorney, Agent, or Firm*—Frank B. Robb; Robb & Robb

[57] ABSTRACT

The present invention relates to a mail box mounting device comprising a lower body having mounting means such that the lower body can be mounted on a support structure and an upper body rotatably engaged to the lower body, such that the upper body can be rotated without rotating the lower body, and having fastening means such that a mail box can be fastened thereto. The present invention also has positioning means such that the upper body automatically returns to certain positions with respect to the lower body when the upper body is not being rotated.

2 Claims, 2 Drawing Sheets

MAIL BOX MOUNTING DEVICE

BACKGROUND OF THE INVENTION

The present invention relates generally to the field of mounting devices and, more specifically, to mounting devices for mail boxes.

Roadside located mailboxes are positioned to allow for easy access by the mail carrier when he or she delivers mail. Such positioning results in the opening of the mail box being directed outwardly toward the roadway with the open end of the mail box protruding over the edge of the roadway, or closely thereto, such that the mail carrier can insert the mail into the mail box without leaving his or her vehicle. While this facilitates easy and efficient mail delivery it creates a difficult and dangerous situation for individuals attempting to remove their mail from the mail box.

Mail boxes are, usually, firmly mounted or secured to some type of support frame. As such, the mail box is also firmly positioned and not capable of being repositioned for the purpose of retrieving mail. This forces the individual either to actually stand in the roadway to retrieve the mail or, at the very least, to place a portion of his or her body, whether an arm, leg, hip or other, within the boundaries of the roadway. Obviously, if the individual resides on a busy thoroughfare the simple act of getting one's mail would be a very dangerous and physically threatening endeavor. Similarly, if the individual prefers to retrieve his or her mail from a vehicle, that would require the vehicle to be stopped in the roadway, also creating a dangerous situation. Also, in locations subject to snowfall, snow may be piled at the mail box creating an even more dangerous situation when retrieving mail.

Accordingly, a need exists for a mail box mounting device which allows for safe, easy access and overcomes the above drawbacks.

SUMMARY OF THE INVENTION

The present invention provides a device to satisfy the aforementioned need.

Accordingly, the present invention relates to a mail box mounting device comprising a lower body having mounting means such that the lower body can be mounted on a support structure and an upper body rotatably engaged to the lower body, such that the upper body can be rotated without rotating the lower body, and having fastening means such that a mail box can be fastened thereto. The present invention also has positioning means such that the upper body automatically returns to certain positions with respect to the lower body when the upper body is not being rotated.

BRIEF DESCRIPTION OF THE DRAWINGS

Further features of the present invention will become apparent to those skilled in the art to which the present invention relates from reading the following specification with reference to the accompanying drawings in which.

DESCRIPTION OF THE PREFERRED EMBODIMENT

Figure 1:
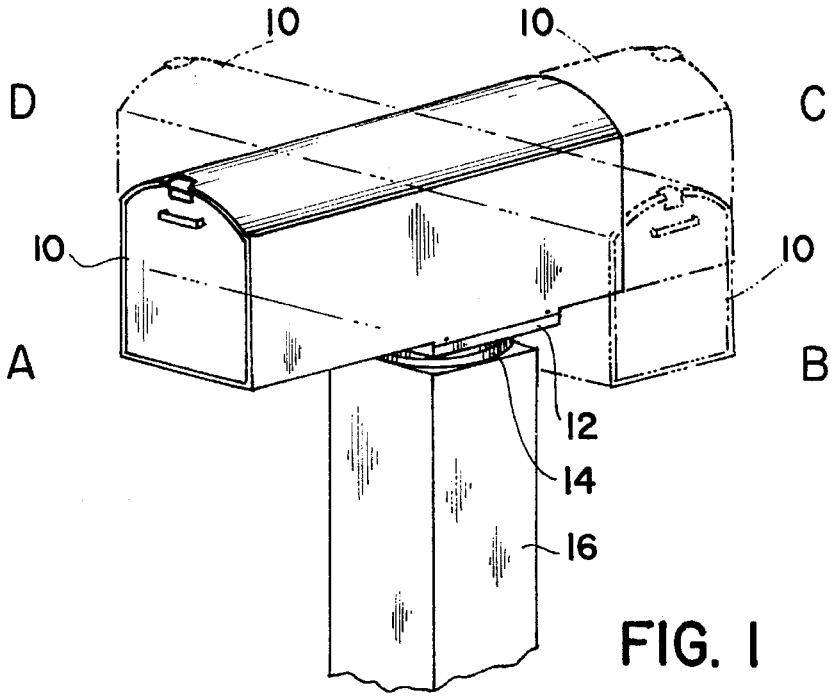
FIG. 1 is a perspective elevation view of the present invention with a mail box and a support structure.

Referring now to the drawings and more particularly FIG. 1, there is shown a perspective elevation view of the present invention with a mail box 10 fastened to the upper body 12 and the upper body 12 rotatably engaged to the lower body 14. The lower body 14 is mounted on a support structure 16. The upper body 12 with the mail box 10 attached thereto is adapted to rotate in a horizontal plane with the point at which the upper body 12 engages the lower body 14 being the vertical axis for such rotation. The lower body 14 and the support structure 16 to which it is attached remain fixed. FIG. 1 shows the mail box 10 and the upper body 12 in different rotated positions A, B, C and D.

Figure 2:
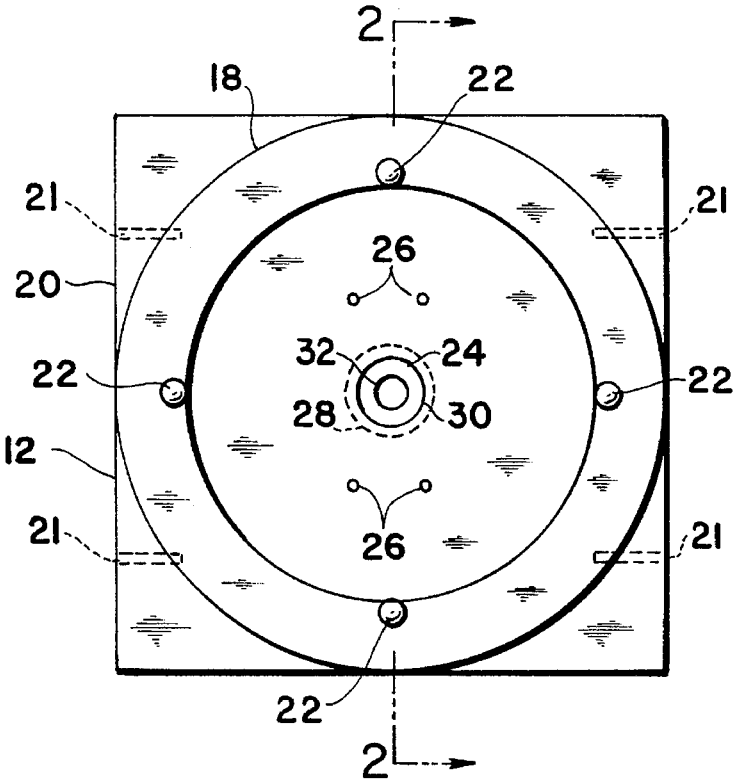
FIG. 2 is a bottom plan view of the upper body of the present invention.
Figure 2A:
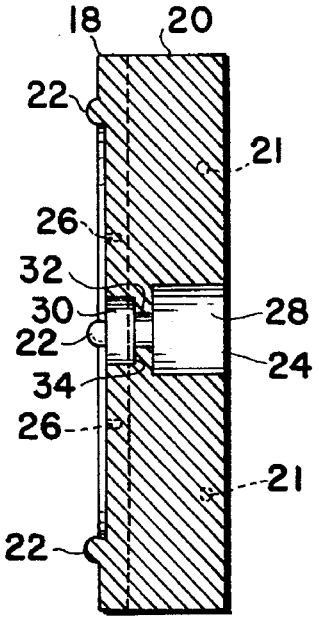
FIG. 2A is a sectional view of FIG. 2.

Referring now to FIG. 2, there is shown a bottom plan view of the upper body 12 and to FIG. 2A which is a sectional view along line 2—2 of FIG. 2. The bottom portion 18 of the upper body 12 is circular shaped while the top portion 20 is rectilinear. The top portion 20 of the upper body 12 has fastening means 21 to allow a mailbox 10 to be fastened thereto. The upper body 12 has a cylindrical opening 24 extending vertically therethrough and at least one detent 22 extending downward from the bottom portion 18 of the upper body 12. In the preferred embodiment, four detents 22 are shown in a circular orientation each spaced 90 degrees apart. Upper spring means receiving holes 26 open from the bottom portion 18 and extend into the upper body 12. The cylindrical opening 24 is formed to have three different diameters in series. The upper diameter 28 is separated from the lower diameter 30 by a middle diameter 32 formed by a stop 34.

Figure 3:
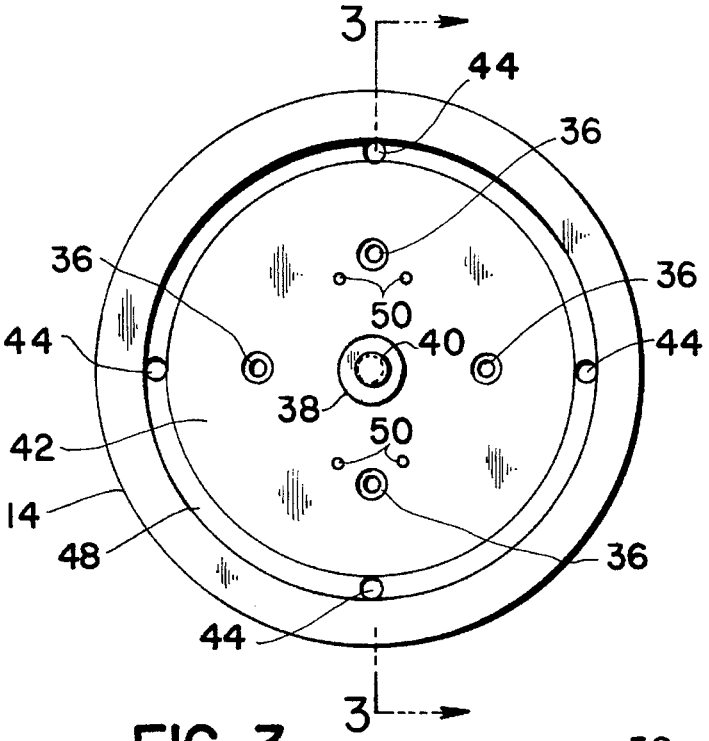
FIG. 3 is a top plan view of the lower body of the present invention.
Figure 3A:
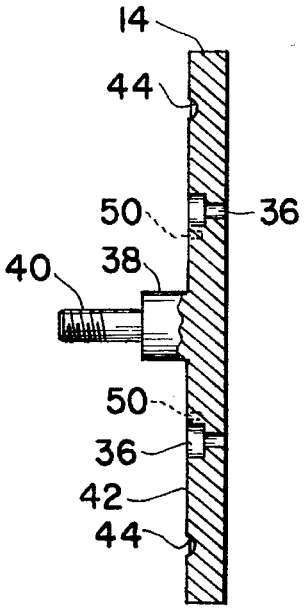
FIG. 3A is a sectional view of FIG. 3.

Referring now to FIG. 3, there is shown a top plan view of lower body 14, and to FIG. 3A which is a sectional view along line 3—3 of FIG. 3. The lower body 14 is circular in shape and has mounting means 36 for mounting to a support structure 16 (not shown in FIGS. 3 or 3A). In the preferred embodiment of the present invention, the mounting means 36 comprises four equally spaced mounting holes. A cylindrical collar 38 terminating in a threaded stud 40 extends upwardly from the top surface 42 of the lower body 14. The cylindrical collar 38 has a diameter slightly smaller than the lower diameter 30 of the cylindrical opening 24 of the upper body 12 (not shown in FIGS. 3 or 3A). The threaded stud 40 is sized to fit within the middle diameter 32 of the cylindrical opening 24 of the upper body 12. At least one indentation 44 is formed in the top surface 42 of the lower body 14. A circular channel 48 is also provided in the top surface 42 of the lower body 14. The indentation 44 is located within the circular channel 48.

In the preferred embodiment of the present invention, four indentations 44 are shown, each spaced 90 degrees apart and located within the circular channel 48. Lower spring means receiving holes 50 open from the top surface 42 and extend into the lower body 14.

Figure 4:
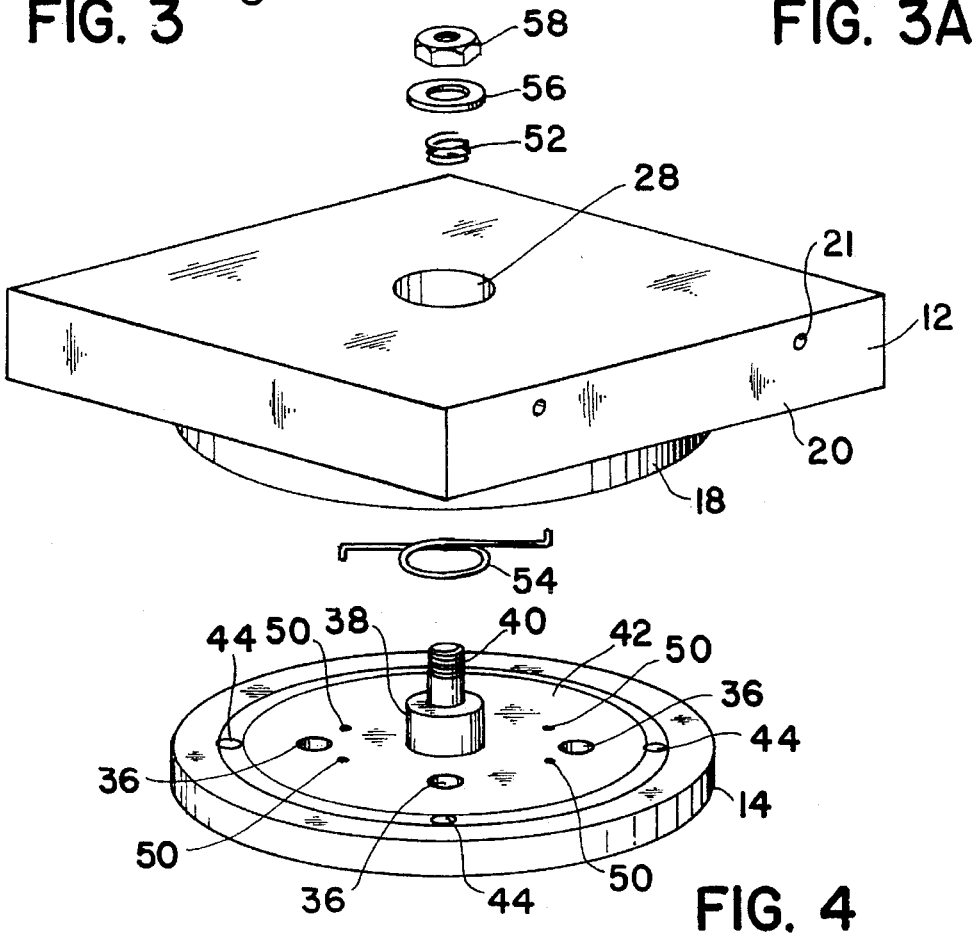
FIG. 4 is an exploded view of the assembly of the upper body and the lower body.

Referring now to FIG. 4, an exploded view of the assembly of the upper body 12 and the lower body 14 is shown. First spring means 52 is located on the threaded stud 40. The circular collar 38, threaded stud 40 and first spring means 52 are inserted in the cylindrical opening 24 of the upper body 12. The threaded stud 40 extends through the middle diameter 32 into the upper diameter 28 while the first spring means 52 contacts the stop 34 allowing the first spring means 52 and the cylindrical collar 38 to extend only through the lower diameter 30. Second spring means 54 is inserted in the upper spring means receiving holes 26 and the lower spring means receiving holes 50. A washer 56 and nut 58 are mounted on the threaded stud 40. As the nut 58 is tightened the bottom portion 18 of the upper body 12 is forced into contact with the top surface 42 of the lower body 14 compressing the first spring means 52 against the stop 34. The first spring means 52 tends to force apart the upper body 12 from the lower body 14 thereby reducing the friction between the upper body 12 and the lower body 14 and facilitating the rotation of the upper body 12. During rotation the detent 22 moves within the circular channel 48 until it locates within the indentation 44.

Referring again to FIG. 1, when an individual wishes to retrieve the mail from, or to deposit mail into, the mail box 10, he or she would rotate the upper body 12 along with the mail box 10 fastened thereto to a certain position or positions to allow access to the opening of mail box 10. During this rotation, the lower body 14 remains fixed and accordingly does not also rotate. After the individual retrieves the mail from, and/or deposits the mail in, the mail box 10, or at any other time when the upper body 12 is not rotating, the automatic positioning means retains the upper body 12, and the mail box 10 fastened thereto, in certain positions with respect to the lower body 14.

In the preferred embodiment of the present invention, the positioning means comprises the detents 22, the indentations 44, the circular channel 48 and the second spring means 54. FIG. 1 shows that the mail box 10 can be in four positions "A", "B", "C" and "D". When the mail box 10 is in these positions it is retained thereat by each detent 22 being located in a separate indentation 44. The four detents 22 and four indentations 44 therefore, are located to coordinate with the four positions "A", "B", "C" or "D". In its normal position, the mail box 10 is oriented so that the opening is toward the roadway; position "A". When an individual wishes to retrieve the mail from, or to deposit mail into, the mail box 10, he or she would lift the mail box 10 slightly, aided by the first spring means 52, to allow each detent 22 to dislocate from the particular indentation 44, and then would rotate the upper body 12 with the mail box 10 attached thereto, from position "A" to a position to allow access to the mail box 10; positions "B", "C" or "D". During rotation the detents 22 move within the circular channel 48 and the second spring means 54 is put under tension. After the individual retrieves the mail from, and/or deposits the mail in, the mail box 10, the upper body 12 and the mail box 10 are retained in that particular position until the upper body 12 and the mail box 10 are manually lifted, to dislocate the detents 22 from the indentations 44. The second spring means 54 then automatically rotates the upper body 12 in the reverse rotational direction until the detents 22 locate in the nearest indentations 44 in that reverse rotational direction.

While the preferred embodiment of the invention has been shown and described, it will be apparent to those skilled in this art that various modifications may be made in this embodiment without departing from the teachings of the present invention.

What is claimed is:

1. A mail box mounting device, comprising:

a) a lower body having mounting means such that said lower body can be mounted on a support structure, and wherein said lower body has a top surface;

b) an upper body rotatably engaged to said lower body such that said upper body can be rotated without rotating said lower body and having fastening means such that a mail box can be fastened thereto, and wherein said upper body has a top portion and a bottom portion and a cylindrical opening extending therethrough such that said cylindrical opening is formed to have three different diameters in series, an upper diameter, a middle diameter and a lower diameter whereby said middle diameter is formed by a stop;

c) a cylindrical collar terminating in a threaded stud extending upwardly from said lower body such that said threaded stud inserts into said cylindrical opening of said upper body;

d) first spring means mounted on said threaded stud; and e) a nut mounted on said threaded stud after said threaded stud inserts in said cylindrical opening in said upper body whereby as said nut is tightened said bottom portion of said upper body is forced into contact with said top surface of said lower body compressing said first spring means against said stop wherein said first spring means tends to force apart said upper body from said lower body thereby reducing the friction between said upper body and said lower body.

2. A mail box mounting device comprising:

a) a lower body having mounting means such that said lower body can be mounted on a support structure and further having at least one detent extending downwardly from an upper body;

b) said upper body rotatably engaged to said lower body such that said upper body can be rotated without rotating said lower body, and having fastening means such that a mail box can be fastened thereto, and further having at least one indentation and a circular channel such that when said upper body is rotated said detent locates in said indentation by moving within said circular channel and wherein said upper body has a top portion and a bottom portion and a cylindrical opening extending therethrough such that said cylindrical opening is formed to have three different diameters in series, an upper diameter, a middle diameter and a lower diameter whereby said middle diameter is formed by a stop;

c) a cylindrical collar terminating in a threaded stud extending upwardly from said lower body such that said threaded stud inserts into said cylindrical opening of said upper body;

d) first spring means mounted on said thread stud; and e) a nut mounted on said threaded stud after said threaded stud inserts in said cylindrical opening in said upper body whereby as said nut is tightened said bottom portion of said upper body is forced into contact with said top surface of said lower body compressing said first spring means against said stop wherein said first spring means tends to force apart said upper body from said lower body thereby reducing the friction between said upper body and said lower body;

f) second spring means attached to said upper body and said lower body such that when said upper body is rotated said second spring means is put under tension and forces said upper body to return to it original position after rotation is completed.

* * * * *